United States Patent [19]

Schultz

[11] 4,172,687

[45] Oct. 30, 1979

[54] BACKHOE SKIP ATTACHMENT

[75] Inventor: Gene Schultz, 117 27th Ave. North, Fargo, N. Dak. 58102

[73] Assignees: Gene Schultz; Earl W. Sornsin, both of Fargo, N. Dak.

[21] Appl. No.: 858,092

[22] Filed: Dec. 7, 1977

[51] Int. Cl.[2] ..... E02F 3/96

[52] U.S. Cl. ..... 414/724; 37/117.5

[58] Field of Search ..... 214/92, 138 R, 145 R, 214/145 A, 523, DIG. 5; 37/117.5, 142.5, DIG. 3, DIG. 12; 294/68, 69 R, 73

[56] References Cited

U.S. PATENT DOCUMENTS

| | | | |
|---|---|---|---|
| 3,039,210 | 6/1962 | Slaughter | 37/117.5 |
| 3,195,747 | 7/1965 | Kashergen | 214/138 R |
| 3,440,744 | 4/1969 | Smith | 214/145 R X |
| 3,478,449 | 11/1969 | Baker | 37/117.5 X |
| 3,706,388 | 12/1972 | Westendorf | 214/145 R |

*Primary Examiner*—L. J. Paperner

*Attorney, Agent, or Firm*—Schroeder, Siegfried, Ryan, Vidas, Steffey & Arrett

[57] ABSTRACT

A sand and gravel skip or the like adapted for ready attachment to the bucket of a backhoe.

14 Claims, 4 Drawing Figures

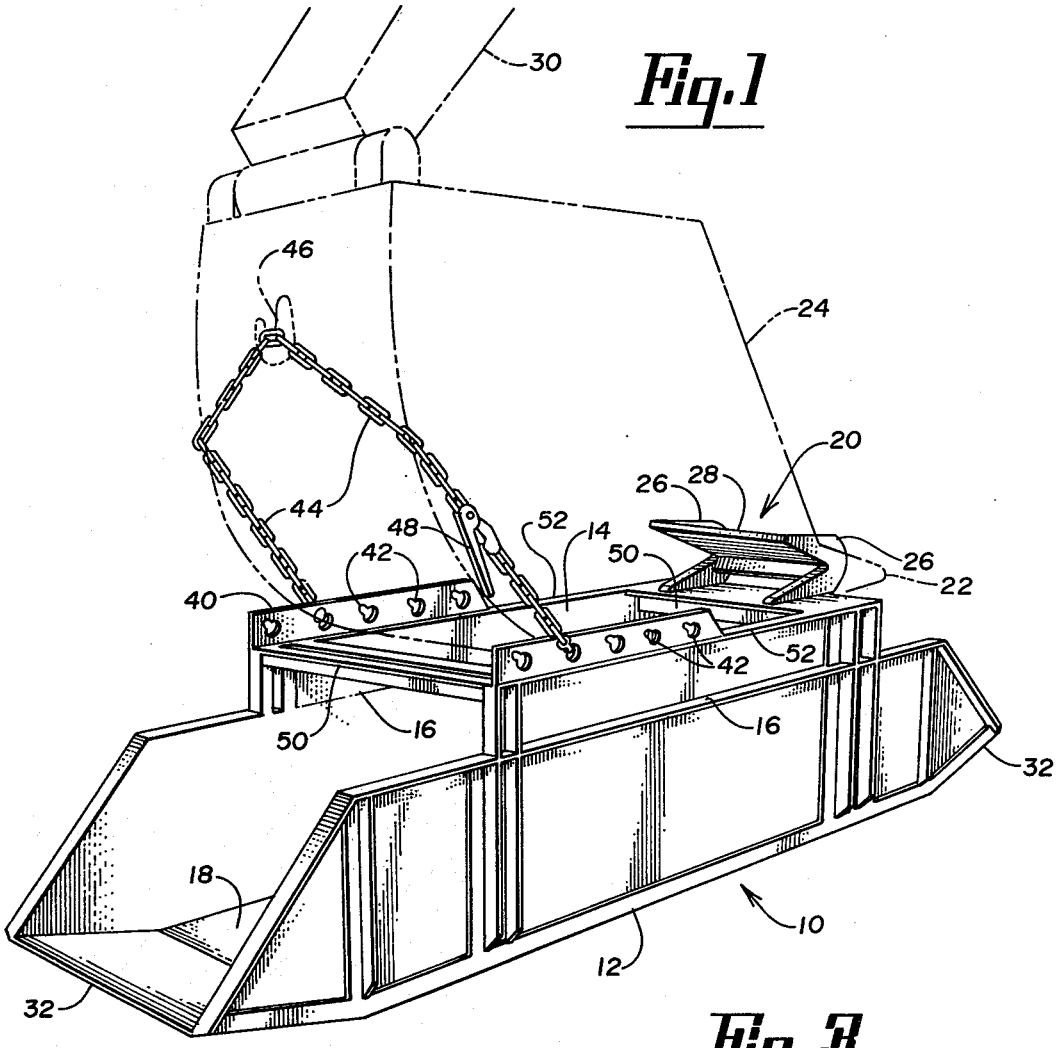
Fig. 1
Fig. 4
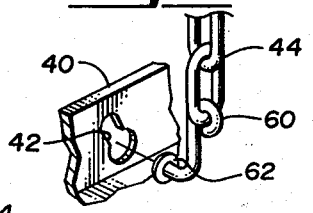
Fig. 3
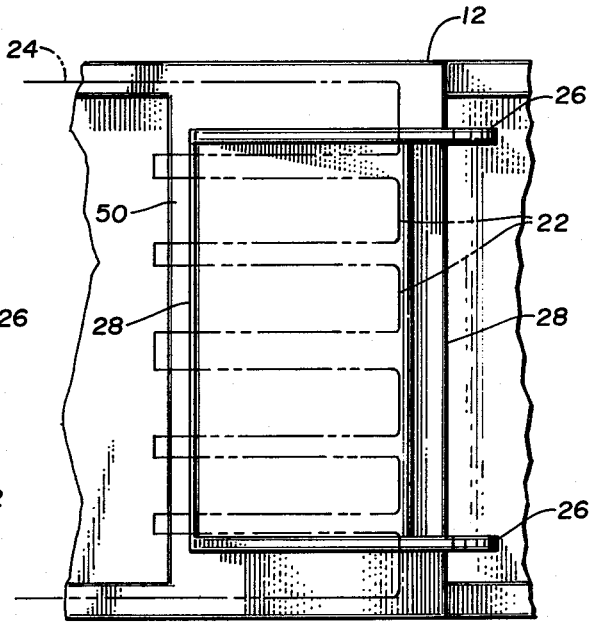
Fig. 2
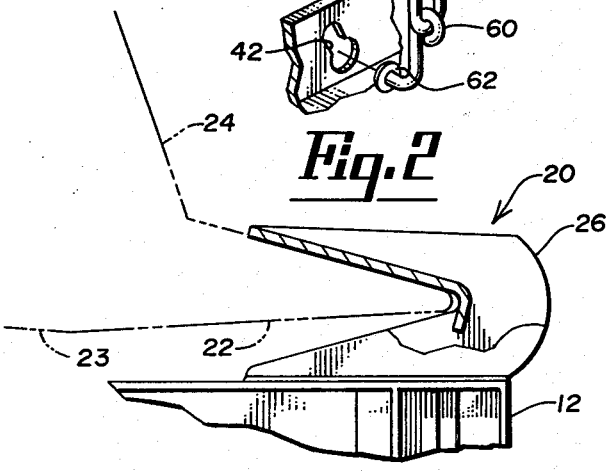

BACKHOE SKIP ATTACHMENT

BACKGROUND

This invention relates to an attachment device for backhoe machines. Backhoes are excavating machines having a scoop or bucket pivotally attached to a movable boom. In excavating, the bucket is drawn toward the machine by boom movement. Backhoes are particularly useful in digging trenches for various purposes such as for pipe laying. In the case of pipe laying, it is frequently required that sand or other select material be placed in the bottom of the trench for bedding the pipe. After the pipe is laid to grade, it is covered with the sand or select material. Sand and other select material must usually be purchased and hauled to the work site. This is expensive, and the material must be evenly distributed and used as efficiently as possible without waste. After covering the pipe with sand or the like, the trench is then backfilled with the excavated dirt by a dozer, front end loader or the like.

Even so, it has been a standard practice to use a front end loader and a backhoe not only for refilling trenches but for placing sand and other select material as well. In such instances, the front end loader is used to fill the backhoe bucket with the select material, such as sand, gravel, or the like. The backhoe then distributes the load in the trench. As noted above, this practice has several drawbacks, a primary one of which lies in the uneven distribution of the material being dumped into the trench by the backhoe. This necessitates a certain amount of manual labor in achieving a final even distribution of the filling material in the trench. Another drawback is the unnecessary use of select material; i.e., due to poor distribution thereof.

It is an object of the invention to provide a skip attachment device for backhoes which uses a novel arrangement for securing the device to the backhoe bucket.

It is another object of the invention to provide a backhoe skip attachment for use in ditching operations and the like which substantially eliminates the need for excessive manual labor as has been heretofore required in obtaining even distribution of a filling material.

Another object of the invention is to increase the load carrying capacity of a backhoe for filling and distributing purposes and to improve the control over the flow rate of the filling material as it is dumped by the backhoe thus achieving a more even distribution upon dumping.

These and other objects of the invention will become apparent to those familiar with this art upon consideration of the following description and the accompanying drawings.

SUMMARY OF THE INVENTION

This invention provides a skip attachment device for backhoes. In the preferred embodiment is a skip which is adapted for ready connection to the backhoe bucket and which is used to carry and distribute sand, gravel, and the like, particularly when filling trenches. The skip is adapted for connection to the backhoe bucket by a hook-like means arranged for overlapping the digging lip of the bucket thereby connecting one end of the skip to the bucket. The other end of the skip is connected to the bucket by additional connecting means such as chain.

BRIEF DESCRIPTION OF THE FIGURES

FIG. 1 is a perspective view showing the skip in operative attachment to a backhoe bucket.

FIG. 2 is a fragmentary side view of a portion of the skip showing its overlapping connection to the backhoe bucket digging lip.

FIG. 3 is a top plan view of the fragmentary view shown in FIG. 2.

FIG. 4 is a fragmentary showing of a means of attaching chain through a keyhole opening on the skip of FIG. 1.

DETAILED DESCRIPTION OF THE PREFERRED EMBODIMENTS

Referring to the drawing figures in detail a backhoe skip attachment, generally indicated at 10, in accordance with the present invention includes a, preferably rectangular, preferably symmetrical-shaped, body 12 having a, preferably substantially open, top portion 14, closed sides 16, and a bottom 18. Skip body 12 also includes at least one open end. However, preferably, it is open-ended front and rear as shown in FIG. 1. Bottom 18 of skip body 12 may be inclined upwardly near an end or ends thereof as shown at 32.

Skip body 12 also includes a hook-like means generally indicated at 20 and carried at the top of body 12 as shown in FIG. 1. Hook-like means 20 is arranged at or near one end of skip body 12 and projects toward the other end thereof as shown for overlapping the digging lip 22 which is the termination of a portion 23 of a backhoe bucket 24. By ordinary manipulation of bucket 24 on backhoe boom 30, digging lip 22 may be readily inserted under the hook-like means 20 as shown in the Figures thereby connecting body 12 to the bucket. Preferably, hook-like means 20 will be elongated transversely relative to the width of skip body 12 and may, for this reason, include laterally spaced end portions or hook members 26 which are interconnected by a plate 28. Preferably plate 28 will be shaped to conform to digging lip 22 of backhoe bucket 24. However, a pair of separate laterally spaced hook means is also acceptable. As shown in detail in FIG. 3, the digging lip may be toothed.

Additional connecting means is provided by a pair of laterally spaced upstanding plate members 40 which are also positioned at the top of skip body 12 toward the other end thereof. Preferably, plate members 40 will each include a plurality of keyhole-shaped openings 42, by means of which a chain 44 or chains may be secured to skip body 12 and also secured to bucket 24 as by hook 46, which is rigidly attached to the bucket, as by welding. The chain will preferably include a tensioning jack or load binder, indicated at 48, by means of which bucket 24 and skip 12 may be tightly secured together after the chain is interconnected between the bucket and the skip.

The plurality of keyhole openings 42 provide for selective attachment of skip body 12 to bucket 24 by means of the chain. An easily removable bolt 60 with enlarged head 61 may be used to secure chain 44 through keyhole opening 42 as shown in FIG. 4.

Preferably, skip body 12 will include a structural framework attached to sides 16 including upper spaced transverse and lateral frame members 50 and 52 respectively by means of which hook-like member 20 and plate members 40 may be conveniently supported and attached to skip body 12.

In operation, the digging lip 22 of bucket 24 is received by hook-like member 20, and chains 44 are securely attached to bucket 24 by means of hooks 46 and to skip body 12 by means of bolts 60 and keyholes 42. Load binders 48 are then used to tighten the chain. Thus, after skip 10 is securely attached to bucket 24, it may be moved therewith during operation of the backhoe in the conventional manner.

The skip of this invention may be built in many varying sizes depending upon the size of the ditch to be filled, the size of the backhoe to which the skip is to be attached, and so forth.

Various changes may be made in the structural details of the invention. Thus, it is not intended to limit the invention to the specific embodiments described but rather to define the invention by the following claims.

What is claimed is:

1. A skip adapted for attachment to the bucket of a backhoe, the skip comprising: a body having a top portion, closed sides and a bottom, and at least one open end, hook-like means carried at the top near one end of the body and projecting toward the other end thereof for overlapping the lip of a backhoe bucket upon attachment of the skip thereto, and additional connecting means having first and second elements disposed toward the other end of said skip, the first of said elements disposed longitudinally along said skip body and the second of said elements constructed and arranged for releasably engaging selected positions along said first element for connecting said skip to the bucket.

2. The skip of claim 1 wherein the body is open-ended both front and rear.

3. The skip of claim 1 wherein the bottom inclines upwardly near the open end.

4. The skip of claim 1 wherein the hook-like means comprises a pair of laterally spaced hook-like members.

5. The skip of claim 4 wherein the hook-like members are interconnected by a plate member for providing additional engagement with a bucket lip.

6. The skip of claim 5 wherein the interconnecting plate member is shaped to conform to a bucket lip.

7. The skip of claim 1 wherein the second element includes chain.

8. A skip adapted for attachment to the bucket of a backhoe, the skip comprising: a body having a top portion, closed sides and a bottom, and at least one open end, hook-like means carried at the top near one end of the body and projecting toward the other end thereof for overlapping the lip of a backhoe bucket upon attachment of the skip thereto, and additional connecting means including chain on the skip toward the other end thereof for attachment to the bucket, the additional connecting means further including a pair of laterally positioned upstanding plate members at the top sides of the skip body, each plate member including a series of openings by which a length of the chain may be selectively secured to the skip.

9. The skip of claim 8 wherein the openings are keyhole-shaped openings.

10. The skip of claim 8 wherein the body further includes a framework attached to the sides of the body and including upper spaced transverse and lateral frame members for carrying the hook-like means and the upstanding plate members.

11. The skip of claim 10 wherein the body is open-ended front and rear.

12. The skip of claim 11 wherein the bottom inclines upwardly near each end.

13. The skip of claim 11 wherein the top is substantially open.

14. A skip adapted for attachment to the bucket of a backhoe, the skip comprising: a body having a top portion, closed sides and a bottom, and at least one open end, hook-like means carried at the top near one end of the body and projecting toward the other end thereof for overlapping the lip of a backhoe bucket upon attachment of the skip thereto, and additional connecting means on the skip toward the other end thereof for attachment to the bucket, the additional connecting means including a pair of laterally positioned upstanding plate members at the top sides of the skip body, each plate member including a series of openings by which a length of chain or the like may be used to secure the skip to the bucket.

* * * * *

UNITED STATES PATENT AND TRADEMARK OFFICE

CERTIFICATE OF CORRECTION

PATENT NO. : 4,172,687

DATED : October 30, 1979

INVENTOR(S) : Gene Schultz

It is certified that error appears in the above—identified patent and that said Letters Patent is hereby corrected as shown below:

Column 2, line 61, delete "61" and insert -- 62 --.

Signed and Sealed this

*Fifth* Day of *February 1980*

[SEAL]

*Attest:*

SIDNEY A. DIAMOND

*Attesting Officer*

*Commissioner of Patents and Trademarks*